US006099445A

United States Patent [19]

Rovinsky et al.

[11] Patent Number: 6,099,445

[45] Date of Patent: Aug. 8, 2000

[54] DEVICE FOR EXERCISING WHILE DOING OFFICE WORK, WATCHING TV, ETC.

[76] Inventors: William Rovinsky, 212 Hey Path Rd., Old Bethpage, N.Y. 11804; Iiya Zborovsky, 6 Schoolhouse Way, Dix Hills, N.Y. 11746

[21] Appl. No.: 09/018,384

[22] Filed: Feb. 4, 1998

[51] Int. Cl.[7] ..... A63B 21/00

[52] U.S. Cl. ..... 482/121; 482/142; 482/130

[58] Field of Search ..... 482/121–130, 482/142, 124; 297/188.11

[56] References Cited

U.S. PATENT DOCUMENTS

| | | | |
|---|---|---|---|
| 217,918 | 7/1879 | White | 482/130 |
| 1,973,945 | 9/1934 | Chavin et al. | 482/130 |
| 3,707,284 | 12/1972 | Waldeck | 482/130 |
| 4,372,605 | 2/1983 | Cesvantes | 247/188.11 |
| 5,090,694 | 2/1992 | Pauls et al. | 482/130 |
| 5,176,601 | 1/1993 | Reynolds | 482/132 |
| 5,254,064 | 10/1993 | Rock | 482/123 |
| 5,362,296 | 11/1994 | Wang et al. | 482/130 |
| 5,498,222 | 3/1996 | Hur | 482/130 |
| 5,599,260 | 2/1997 | Rovinsky et al. | 482/121 |
| 5,690,594 | 11/1997 | Mankovitz | 482/130 |
| 5,743,832 | 4/1998 | Sands et al. | 482/130 |

*Primary Examiner*—Jerome Donnelly
*Attorney, Agent, or Firm*—I. Zborovsky

[57] ABSTRACT

A device for exercising while doing office work, watching TV, etc., has a rigid frame mountable on a central column of a chair or the like; and a plurality of exercising elements connected with the rigid frame and engageable by a user for exercising corresponds parts of a user's body.

12 Claims, 4 Drawing Sheets

DEVICE FOR EXERCISING WHILE DOING OFFICE WORK, WATCHING TV, ETC.

BACKGROUND OF THE INVENTION

The present invention relates to a device for exercising, in particular for such a device which can be used for exercising while doing office work in an office, watching TV at home, etc.

It is well known that exercising is very important for maintaining persons health, and many exercising devices have been developed. Usually, the exercising devices used outside home are separate devices which are located in special exercising places, etc. Even home exercising devices are separate devices designed and arranged so that a user has to use the exercising device and can not simultaneously sit on a sofa, a chair, etc. It is therefore believed that it is advisable to develop such an exercising device which can be used when a user does his office work while sitting on a chair, when a user watches TV sitting on a chair at home, etc. One of such devices is disclosed in our U.S. Pat. No. 5,599,260. It is believed that these devices can be further improved.

SUMMARY OF THE INVENTION

Accordingly, it is an object of present invention to provide an exercising device which is an improvement of existing devices.

In keeping with these objects and with others which will become apparent hereinafter, one feature of present invention resides, briefly stated, in an exercising device which has a rigid frame mountable on a central column of a chair; and a plurality of exercising elements connected with and extending from said rigid frame so as to be engaged by a user and provide exercising for a user.

When the device is designed in accordance with present invention, it is easily mountable on a office chair in an office so that a person can do his officework while exercising, on a regular home chair so that a person can sit on the chair and watch TV while exercising, etc.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
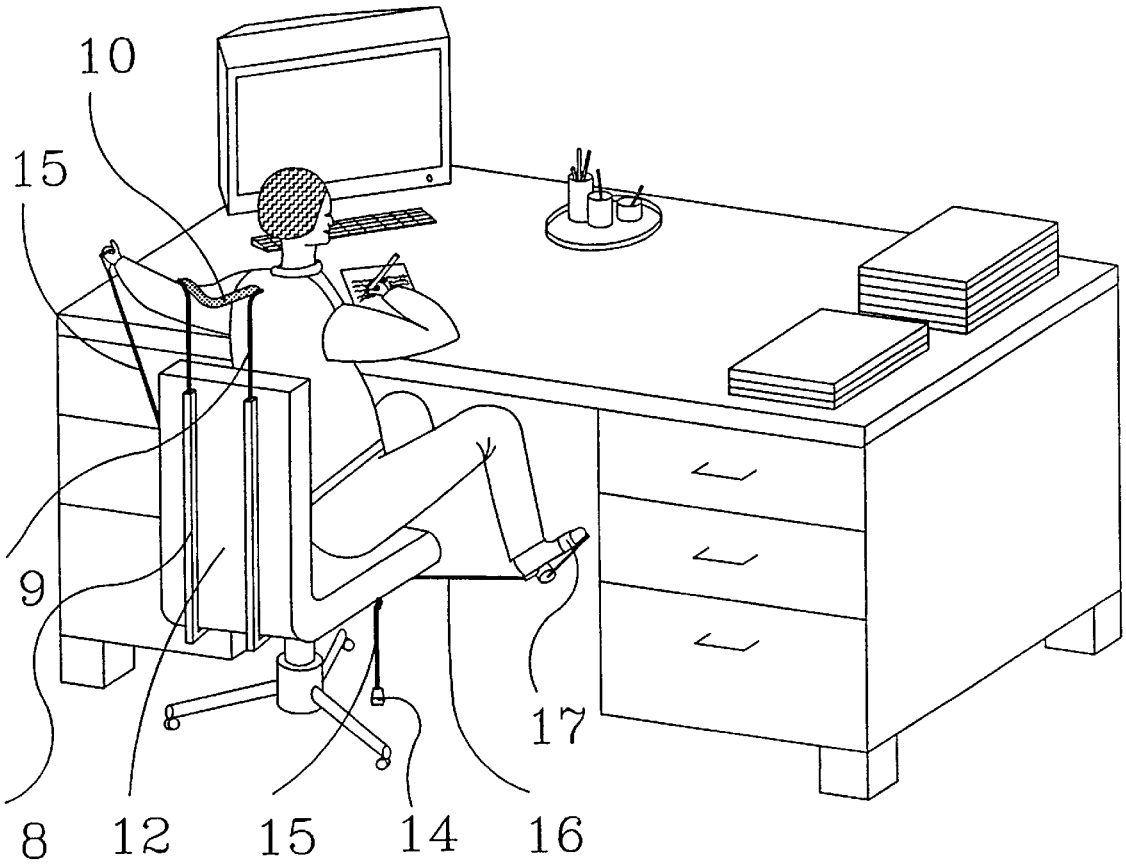
FIG. 1 is a view schematically showing a device for exercising mounted on a chair in a perspective view with a user during exercising.
Figure 2:
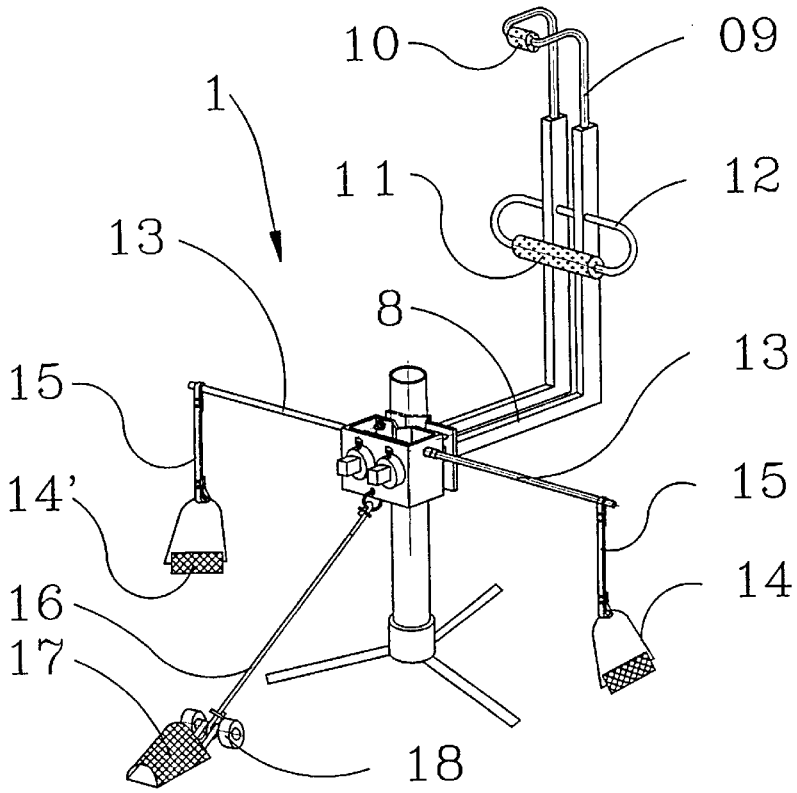
FIG. 2 is a perspective view of the exercising device in accordance with the present invention.
Figure 3:
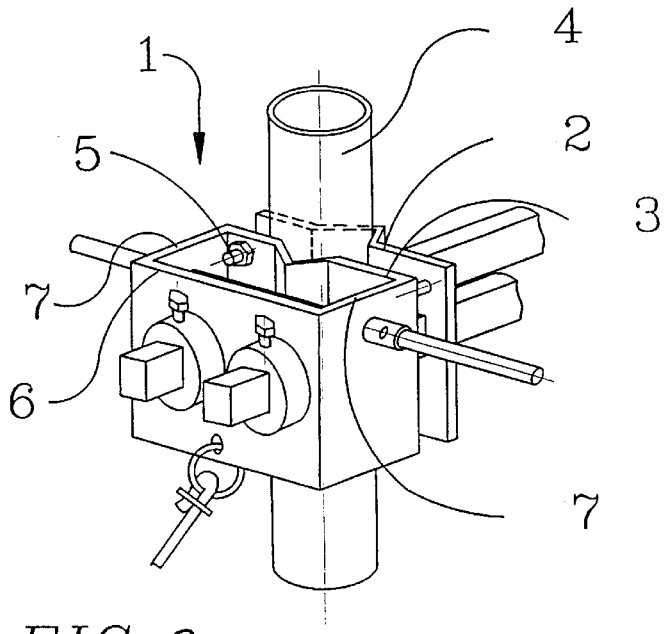
FIG. 3 is an enlarged view of a mounting frame of the inventive exercising device.

An exercising device in accordance with present invention has a rigid frame each identified as a whole with reference numeral 1. The frame 1 has two wall plates 2 and 3 which are adapted to be located at two opposite sides of a central column 4 of a chair and rigidly connected with one another, for example by screws 5 extending through the corresponding openings of the wall plates 2 and 3 and provided with nuts. One of the wall plates 3 is a part of a substantially rectangular member which has another wall plate 6 fixedly connected with a wall plate 3 by transverse plates 7. Therefore, a rigid and sturdy rectangular structure 3, 6, 7 is formed. It is necessary to support the exercising elements which will be explained in detail later on.

The exercising elements attached to the frame 1 include two rod elements 8 extending through the frame or more particularly through its wall plates 2, 3 and 6 and fixed for example by screws. Therefore, the rods 8 are firmly and non-flexibly connected with the frame 1. The rods 8 have a horizontal part and a vertical part. A telescopable bracket with two rods 9 insertable into the vertical parts of the rods 8 is provided with a neck exercise element 10 at its upper end. The neck exercising element 10 is an elastic element, while the rods 9 of the bracket and/or the vertical parts of the rods 8 are substantially springy. A user can abut his neck against the exercising element 10 and deflect the rods 9, 8 backwardly with overcoming a resistance to the user's neck. Therefore, the user's neck is exercised.

The exercising device further has a lumbar support 11 which can be formed as an elastic, for example plastic foam roller. The roller 11 is connected by an oval connecting element 12 with the vertical parts of the rods 8. In the operative position shown in FIG. 1, the lumbar support 11 is located on the front surface of the back part of the chair for supporting a lumbar area of the user, so that a user can rest against the lumbar support 11, and also exercise by compressing it with the user's back. The parts of the element 12 can be connected with the upper parts of the rods 8 by loops which firmly but movably embrace the upper parts of the rods 8, to adjust the vertical position of the lumbar support 11 by moving the element 11 up or down.

The device further has two hand exercising elements including elongated substantially horizontal bars 13 connected with the frame 1 and provided at their ends with handles 14 which are connected with the bar 13 by an elastic cord 15 or the like. When a user holds the handles 14, he can stretch the elastic cords 15 so as to exercise his arms. The handles 14 can be mounted on further bars 13' telescopably connected with the bars 13 to adjust the horizontal length of the structure 13, 13' and to be accommodated to any chair.

The device further has a leg exercising element including an elastic cord 16 connected with the mounting frame 1 and provided at its free end with a loop 17 formed for introducing a foot and mounted on a roller 18. A user can put his foot into the loop and stretch the cord 16 while rolling the loop with the foot on the roller 18, thus exercising its leg as disclosed in our U.S. Pat. No. 5,599,260. As can be seen of from the drawings, the bars 13 are connected with the transverse plates 7 of the rectangular member of the mounting frame, while the cord 16 is connected with the front wall part 6.

Figure 4:
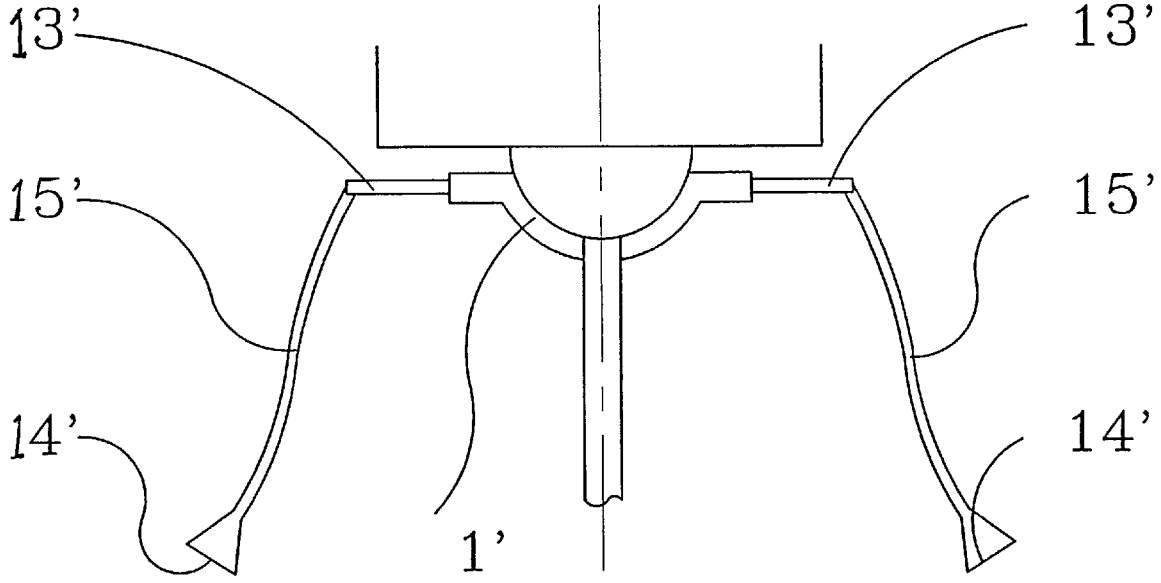
FIG. 4 is a view showing a further embodiment of the exercising device in accordance with the present invention.

FIG. 4 shows a further embodiment of the exercising device. The frame here is identified with reference numeral 1' and fixed to a box under the seat of the chair for example by screws. Horizontal bars 13' are telescopably connected with the frame 1'. The elastic cord 15' are connected with the bars 13' and carry the handles 14'.

In this construction the bars 13' can move horizontally so as to reach the edges of the seat, and thereby when a user pulls the cord 15' they do not interfere with the seat of the chair.

In accordance with still a further embodiment of the present invention a receiving element 21 is fixed on the central column for example by a known tie-wrap element 22. The receiving element 21 is formed as a hollow.

Figure 6:
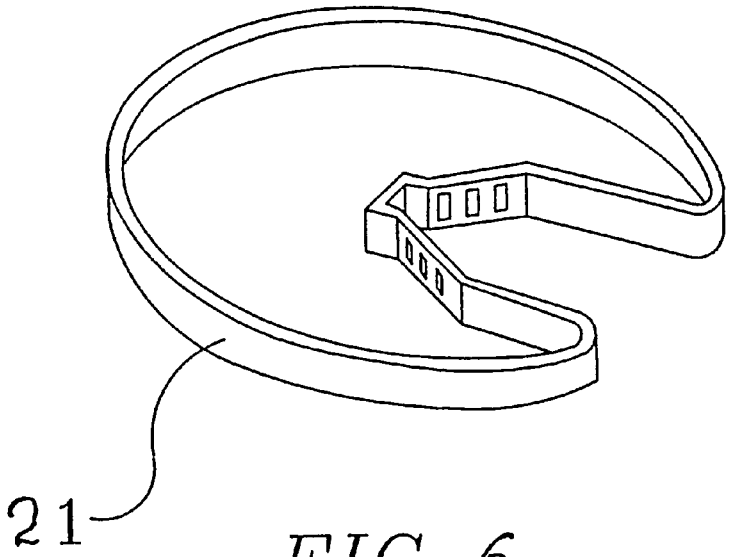
FIGS. 5 and 6 are view showing still a further modification of the invention.
Figure 5:
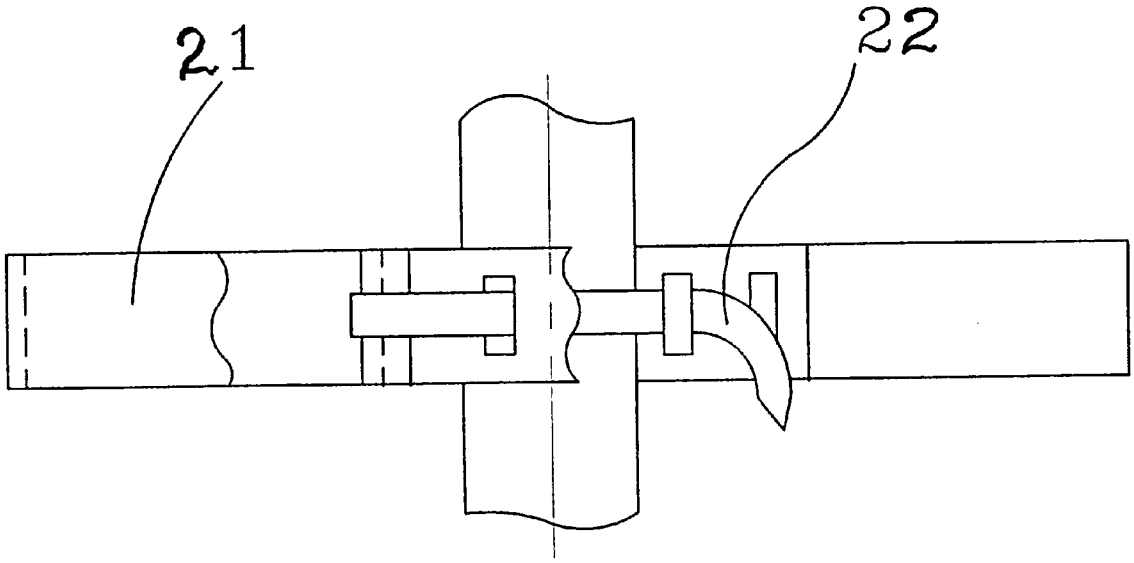

In accordance with still a further embodiment of the present invention a receiving element 21 is fixed on the central column for example by a known tie-wrap element 22. The receiving element 21 is formed as a hollow cap and after the exercising, the cord and the handles can be placed into the interior of the cap. This is shown in FIGS. 5 and 6.

It will be understood that each of the elements described above, or two or more together, may also find a useful application in other types of constructions differing from the types described above.

While the invention has been illustrated and described as embodied in a device for exercising while doing office work, watching tv, etc, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. A kit for exercising while sitting, comprising mounting means mountable on a central column of a chair, a plurality of exercising elements connected with said mounting means and engageable by a user for exercising corresponding parts of a user's body; storing means for storing said exercising elements after the exercising, said storing means including a hollow receiving element which has a passage adapted to surround the central column, is fixable on the central column and has an interior for placing said exercising elements into said interior of said receiving element after the exercising; and means for fixing said receiving element on the central column.

2. A kit as defined in claim 1, wherein said receiving element is formed as hollow upwardly open hollow cap having a central opening through which the central column passes when said hollow upwardly open cap is fixed on the central column, said fixing means including tie-wrap element which fixes said hollow tap on the central column.

3. A kit as defined in claim 1, wherein said rigid mounting means has two wall parts adapted to be arranged at opposite sides of the central column and fixedly connected with one another so as to be fixed on the central column.

4. A kit as defined in claim 1, wherein at least one of said exercising elements includes a neck exercising element, said neck exercising element including a substantially springy member having one end connected with said rigid frame mounting means and another free end provided with a neck supporting element so that a user can press his neck against a neck supporting element to deflect said springy member against a resistance from said springy member to the user's neck.

5. A kit as defined in claim 1, wherein said exercising elements include a lumbar supporting element provided with a connecting element connected with said mounting means and adapted to go around a back of a chair so that said lumbar support is located at a front side of the back of the chair and a user's can abut against said lumbar supporting element.

6. A device as defined in claim 5, wherein said connecting element is vertically adjustable relative to said frame.

7. A kit as defined in claim 1, wherein at least one of said exercising elements is formed as a hand exercising element including a stretchable member having one end connected with said mounting means and another end provided with a handle graspable by a user so as to stretch said stretchable element.

8. A kit as defined in claim 7, and further comprising a connecting element which connects said stretchable member with said mounting means and which is horizontally adjustable.

9. A kit as defined in claim 1, wherein at least one of said exercising elements includes a leg exercising element having a stretchable member with one end connected with said mounting means and another end having a member engageable by a foot and a roller on which said member engeable by the foot together with the foot is rollable on a floor surface.

10. A device as defined in claim 1, wherein said storing means is cup-shaped and upwardly open.

11. A device for exercising while sitting, comprising a rigid frame mountable on a central column of a chair, a plurality of exercising elements connected with said rigid frame and engageable by a user for exercising corresponding parts of a user's body, said rigid frame having two wall parts adapted to be arranged at opposite sides of the central column and fixedly connected with one another so as to be fixed on the central column, one of said wall parts being formed as a substantially rectangular fixed member including a third wall part connected with one of said two first-mentioned wall parts by transverse wall parts to form a rigid rectangular structure.

12. A device for exercising while sitting, comprising a frame mountable on a central column of a chair, a plurality of exercising elements connected with said rigid frame and engageable by a user for exercising corresponding parts of a user's body, at least one of said exercising elements including a neck exercising element, said neck exercising elements including a substantially springy member having one end connected with said rigid frame and another free end provided with said neck supporting element so that a user can press his neck against said neck supporting element to deflect said springy member against a resistance from said springy member to the user's neck, said substantially springy member being telescopably expandable in a vertical direction.

* * * * *